United States Patent [19]

Barrieau

[11] 4,449,629

[45] May 22, 1984

[54] DISPLAY AND STORAGE CONTAINER FOR MULTIPLE TOOL PARTS AND THE LIKE

[75] Inventor: Paul B. Barrieau, Farmington, Conn.

[73] Assignee: The Stanley Works, New Britain, Conn.

[21] Appl. No.: 480,141

[22] Filed: Mar. 29, 1983

[51] Int. Cl.[3] ..... B65D 1/24; B65D 85/62; A45C 11/26

[52] U.S. Cl. ..... 206/45.19; 206/45.14; 206/45.34; 206/44 R; 206/373; 220/22; 229/2.5 R

[58] Field of Search ..... 206/45.34, 45.19, 45.14, 206/45.17, 349, 373, 372, 366, 45.11, 44 R, 541, 305, 378; 220/22, 20; 229/2.5; 150/0.5

[56] References Cited

U.S. PATENT DOCUMENTS

| | | | |
|---|---|---|---|
| D. 167,868 | 9/1952 | Selikoff et al. . | |
| D. 190,974 | 7/1961 | Salis . | |
| D. 232,161 | 7/1974 | Gibson . | |
| 2,013,051 | 9/1935 | Hermani | 220/22 |
| 3,013,656 | 12/1961 | Murphy, Jr. | 206/370 |
| 3,066,790 | 12/1962 | Armbruster | 206/305 |
| 3,171,700 | 3/1965 | Parsell et al. | 206/541 |
| 3,189,170 | 6/1965 | Elliott, Jr. | 206/44 R |
| 3,273,700 | 9/1966 | Roreau et al. | 220/20 |
| 3,285,468 | 11/1966 | Troth . | |
| 3,305,084 | 2/1967 | Higgins et al. | 206/366 |
| 3,327,841 | 6/1967 | Schurman et al. | 150/0.5 |
| 3,357,543 | 12/1967 | Taggart | 206/45.11 |
| 3,370,697 | 2/1968 | Levey et al. | 206/45.34 |
| 3,697,223 | 10/1972 | Kovalcik et al. | 206/370 |
| 4,016,972 | 4/1977 | Szamborski | 206/349 |
| 4,085,845 | 4/1978 | Perfect | 206/45.19 |
| 4,293,074 | 10/1981 | Dunsky | 206/373 |
| 4,340,140 | 7/1982 | Wilcox et al. | 206/45.19 |

OTHER PUBLICATIONS

Sales Brochure of Prent Corporation, Janesville, Wisconsin.

*Primary Examiner*—William T. Dixson, Jr.

[57] ABSTRACT

A unitized display and storage container includes a base member providing an upwardly opening cavity and an outwardly extending peripheral flange about the upper end of its sidewalls, a seat member having a peripheral flange about the lower end of its peripheral wall and a central wall providing a multiplicity of upwardly opening recesses, and a closure member having a central wall portion overlying the recesses of the seat member and a peripheral wall extending downwardly along the exterior surface of the peripheral sidewall and the seat member. Abutting flanges on the base and seat members are secured together, and hinge means is provided to secure the closure member to the seat member at one point about their cooperating peripheries. The seat member includes at least one recess which extends below the plane of the end abutting flanges. The several members may have hanger extensions defining apertures therewithin for hanging the container on a pegboard hook or the like. Unused recesses may be covered by a cover member which is secured to the wall of the seat member surrounding the recess, and a sealing band may encircle the several elements and abut a shoulder on the cover member for its location. The hanger extensions are desirably provided with a contoured edge and recess on their bridge portions to facilitate centering on pegboard hooks or hangers.

18 Claims, 8 Drawing Figures

DISPLAY AND STORAGE CONTAINER FOR MULTIPLE TOOL PARTS AND THE LIKE

BACKGROUND OF THE INVENTION

Various types of containers have been proposed and utilized for the storing of tool sets which include a multiplicity of separate parts. In recent years, there has been an increasing tendency to facilitate the marketing of products by providing containers which could be used not only for display of the products on point of purchase display units such as pegboard displays, but also to serve as a permanent storage case which the purchaser could continue to use for the product.

As will be readily appreciated, such containers should preferably be relatively economical to fabricate and assemble in order to avoid any substantial increase in the cost of the product being marketed therein. However, they must still be attractive, provide the desired utility, and exhibit reasonable durability.

It is an object of the present invention to provide a novel display and storage container which facilitates the display and storage of a multiplicity of tool items and which is of relatively low cost.

It is also an object to provide such a container which may be fabricated readily from synthetic thermoplastic sheet material and which will exhibit reasonable durability and provide an attractive point of purchase display unit which may be hung on pegboard hooks or the like and which is self-centering on such hooks.

Another object is to provide such a container construction having a series of separate recesses to seat a multiplicity of items of different vertical dimension and in which unused recesses may be conveniently and temporarily masked so as to present an attractive "filled" package.

A further object is to provide such a container which will readily evidence pilfering and wherein the pilferproofing element is provided by an attractive component.

SUMMARY OF THE INVENTION

It has now been found that the foregoing and related objects may be readily attained in a unitized display and storage container for multiple items which includes a base member of synthetic resin having a body section of generally U-shaped cross section defined by a bottom wall and sidewall providing an upwardly opening cavity, and a peripheral flange extending outwardly from the upper edge of the sidewall about at least the major portion of its the periphery. A seat member of synthetic resin material is disposed on the base member and has a body section with a peripheral flange extending outwardly about at least the major portion of its periphery thereof and overlying the flange of the base member. An upstanding pedestal portion on the seat member is disposed within its peripheral flange and comprises a peripheral sidewall extending upwardly from the peripheral flange and a central wall portion inwardly of the sidewall and defining a multiplicity of upwardly opening recesses. The central wall portion at the bottom of at least one recess extends below the plane of the peripheral flanges of the seat and base members and into the cavity defined by the base member. Another of the recesses is divided by ribs spaced along opposite sides into a multiplicity of upwardly opening elongated compartments extending between the sides, and the central wall defining the base of these compartments is lower adjacent these sides between the ribs than in its center. As a result, elongated elements seated in these compartments may be readily gripped by pushing one end downwardly to pivot the other end upwardly.

Disposed over the seat member is a closure member having a body section with a central wall portion overlying the central wall portion of the seat member, a sidewall portion extending downwardly therefrom along the exterior surface of the peripheral sidewall of the seat member, and a peripheral flange portion extending outwardly about at least the major portion of its periphery and overlying the flange of the seat member. The sidewall of the closure member frictionally engages the sidewall of the seat member in its closed position, and is removable therefrom to permit access to the items stored in the container.

In the final assembled container, a band of transparent synthetic resin sheet material tightly encircles the base and closure members. The closure may have a transverse shoulder on its central wall portion to provide an abutment for the edge of the band. Moreover, the base member may have ribs thereon to distend and interlock with the band.

In the preferred containers, there is provided means hingedly engaging the closure member to the seat member along a portion of their periphery, whereby the closure member may be pivoted upwardly into a position permitting access to the stored items. This hinge means is conveniently an integral portion of the flange of the closure member, and the flange of the closure member is secured to the base member outwardly of this hinge portion.

To conceal any unused recess in some packages, a cover sheet overlies the recess and is adhered to the central wall of the seat member thereabout. It may be readily removed to permit the purchaser to store separately purchased items therein.

The sidewalls of the seat and closure members are cooperatively inclined upwardly and inwardly from their respective flanges to increase the frictional engagement therebetween. The flanges of the base and seat members extend about substantially the entire periphery thereof and are bonded to seal the cavity defined within the base member.

In the preferred containers, the base and seat members include cooperatively configured and dimensioned hanger extensions at one end of the body section which provide abutting flanges and encompass an aperture extending therethrough to provide a means for hanging the container on an associated support member. The closure member also desirably has a cooperatively dimensioned and configured hanger extension at one end of its body section with a flange abutting that of the seat member hanger extension and encompassing an aperture therethrough aligned with the apertures in the base and seat members.

Preferably, each of the hanger extensions is comprised of side portions extending from the sides of the body sections thereof and a bridge portion extending between the side portions at a point spaced from the body section to define the apertures therebetween. The side and bridge portions of the base member are of a cross section defined by a generally U-shaped central segment and outwardly extending flanges at the upper ends thereof. The side and bridge portions of the seat member and closure members are of a cross section defined by a generally inverted U-shaped central segment and outwardly extending flanges at the lower ends thereof.

Preferably, the central segments of the hanger sections are each defined by a pair of generally vertically extending legs and a web extending therebetween, and at least one leg of each of the closure and seat members has a cooperatively dimensioned and configured recess formed therein, the inside surface of the recess in the leg of the closure member functioning as a boss frictionally seated in the recess of the seat member to provide a frictional interlock therebetween. Most desirably, these recesses are provided on the opposed inside legs of the segments along each of the side portions of the hanger extensions.

The outer edges of the inner flanges of the bridge sections of the hangers are configured so as to taper from their bridge portions to an apex intermediate the length thereof for centering on a hanger element. Preferably, there is a recess about the apex dimensioned to seat a pair of hanger elements of a loop type hanger.

In some configurations, the sidewall of the base member is of greater depth adjacent one end thereof to define a cavity of increased depth adjacent thereto, and one recess of the seat member is of non-uniform depth.

DETAILED DESCRIPTION OF THE ILLUSTRATED EMBODIMENTS

Figure 1:
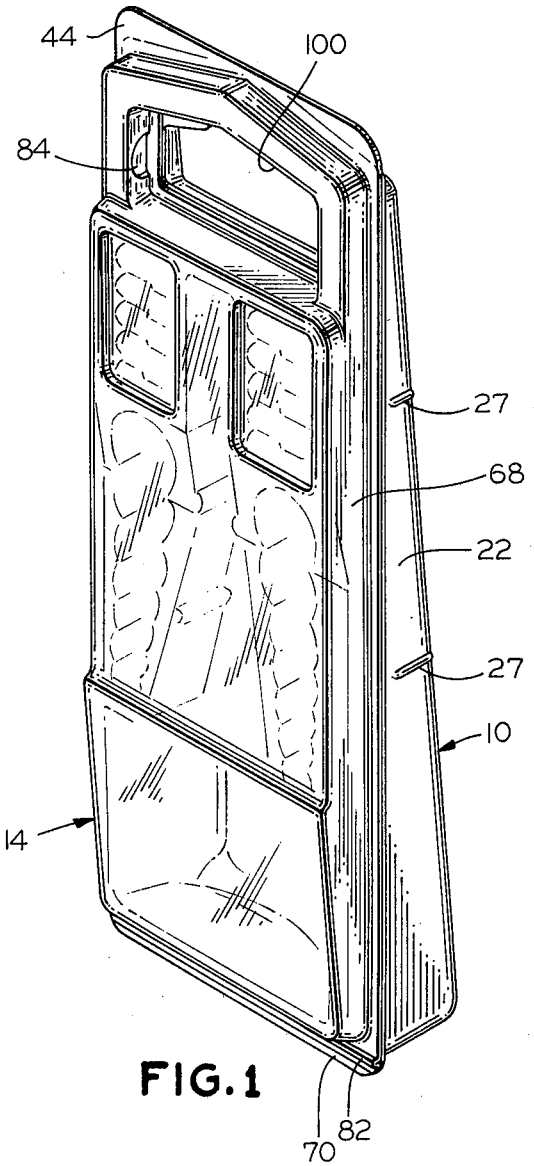
FIG. 1 is a perspective view of a display and storage container embodying the present invention.
Figure 7:
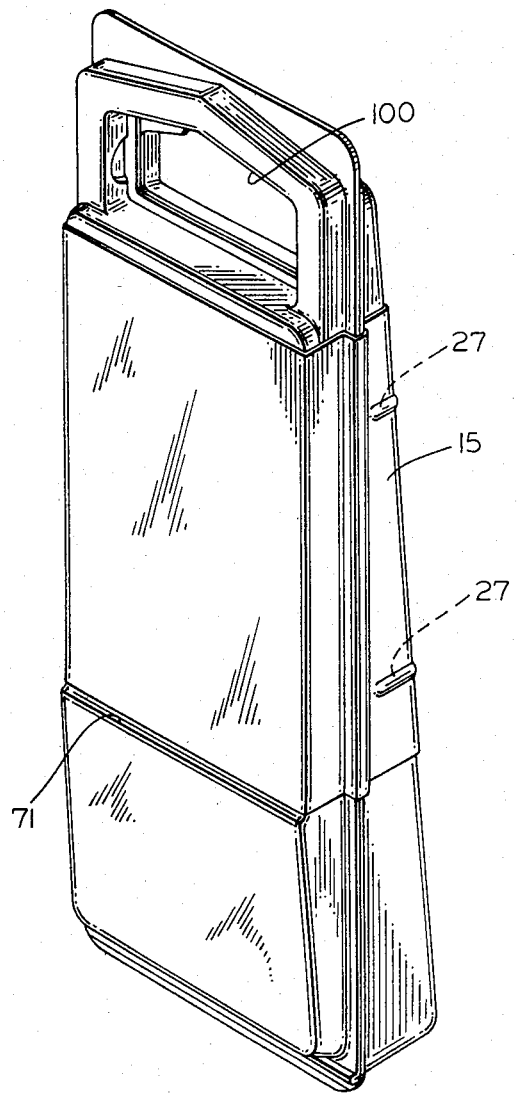
FIG. 7 is a perspective view of the container with the security band disposed thereabout.

Turning now in detail to FIG. 1 of the attached drawings, therein illustrated is a container embodying the present invention and generally comprised of three synthetic resin components assembled into a unitized assembly. A base member generally designated by the numeral 10 is the lowermost element of the assembly, a seat member generally designated the numeral 12 is disposed thereon and bonded thereto, and a closure member generally designated by the numeral 14 is hingedly engaged at one end with the seat member 12 and adapted to pivot from a closed position closely overlying and frictionally engaging the seat member 12 to an open position permitting removal or insertion of tool elements (not shown) therein. In FIG. 7, the container is shown with a transparent sealing band 15 encircling the closure, seat and base members and extending along a substantial portion of the length thereof.

Figure 5:
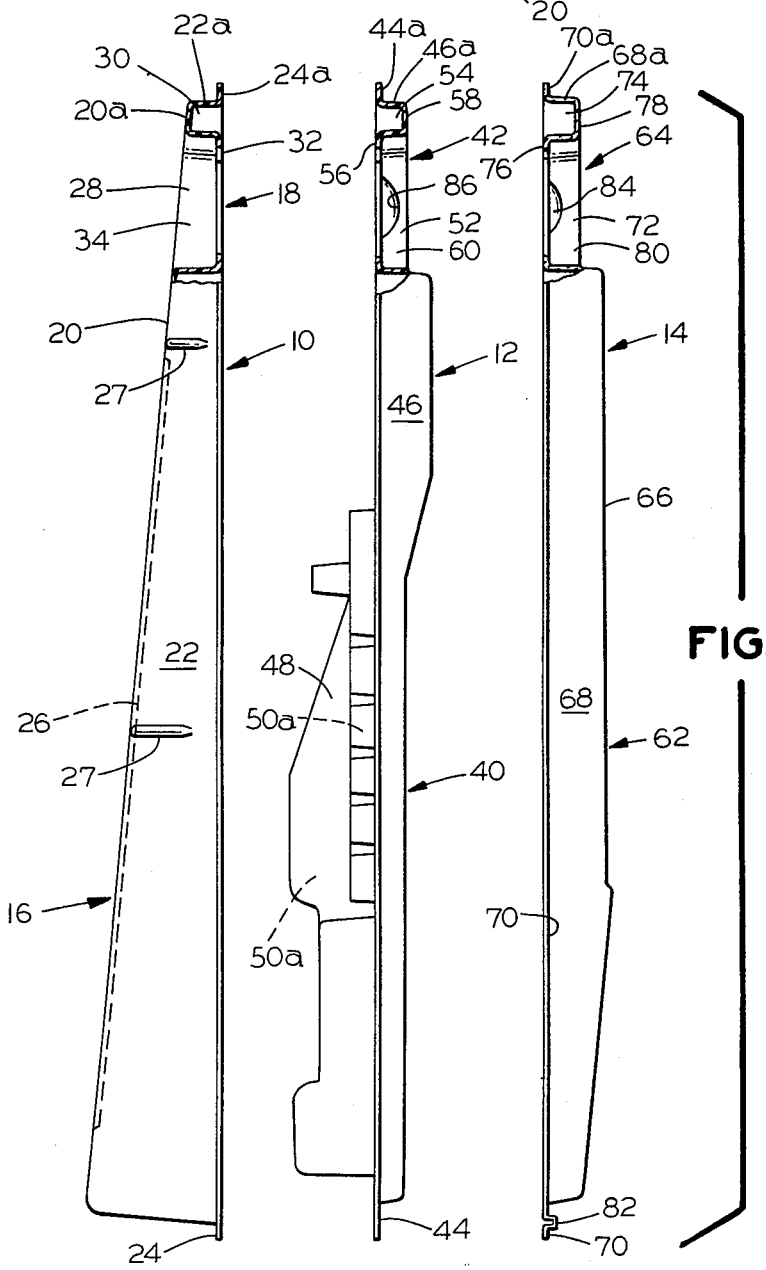
FIG. 5 is an exploded side elevational view of the container with portions of the several members in section to illustrate their construction.

The base member 10 is formed with an elongated body section generally designated by the numeral 16 and a hanger section at one end thereof generally designated by the numeral 18. The body section 16 is of generally rectangular configuration and of generally U-shaped cross section defined by the bottom wall 20, the upwardly and outwardly inclined sidewall 22 and the flange 24 which extends about the periphery of the upper end of the sidewall 22. As best seen in FIG. 5, the base member 10 tapers from its smallest depth at the hanger end to its maximum depth at the hinge end, and the bottom wall 20 of the body section 16 has a central panel portion 26 which is slightly elevated from the plane of the remainder thereof. The sidewall 22 has a pair of vertically extending ribs 27 on each of the elongated side portions.

The hanger section 18 has two side portions 28 and a bridge portion 30, all of which are of generally U-shaped cross section, an outer flange portion **24*a* extending about the upper outer edge thereof and an inner flange portion 32 extending about the upper inner edge thereof. The bottom wall 20*a* of the hanger section 18 is a continuation of the bottom wall of the body section 16 and is coplanar therewith; the outer sidewall 22*a* is a continuation of the sidewall 22 of the body section 16; and the outer flange 24*a* is a continuation of the flange 24 of the body section 16 and is coplanar therewith. The inner sidewall 34 of the side and bridge portions 28,30 blends into the end portion of the sidewall 22 of the body section 16 and tapers upwardly. The inner flange portion 32 of the hanger section 18 lies in the same plane as the flange 24 at the end of the body section 16** and blends thereinto.

Figure 2:
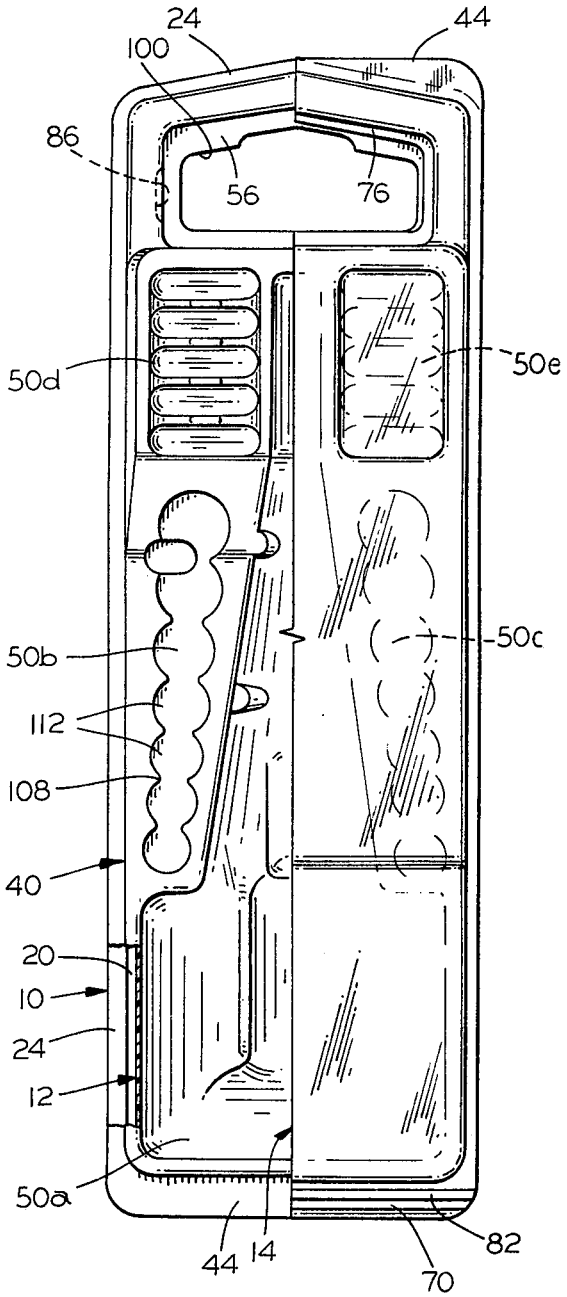
FIG. 2 is a plan view thereof with portions of the closure and seat members broken away to illustrate internal construction.
Figure 3:
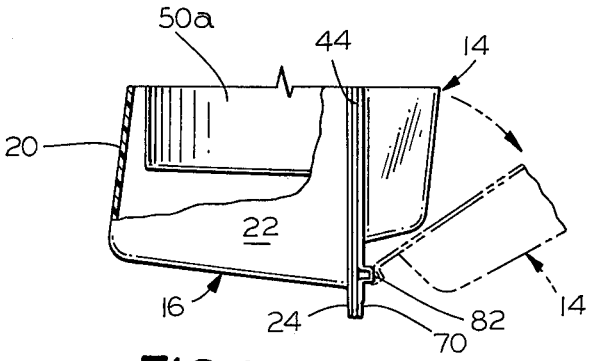
FIG. 3 is a fragmentary side elevational view to an enlarged scale of the hinge end of the container with a portion of the sidewall of the base member broken away and with the closure member shown in phantom line in its pivoted open position.
Figure 4:
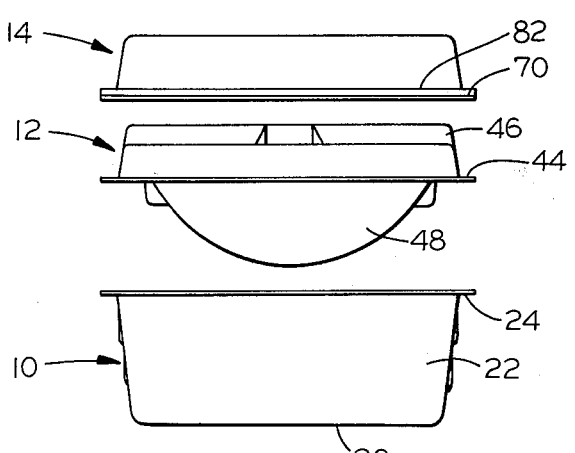
FIG. 4 is an exploded end view of the container.

Turning now to the seat member 12, it has a body section generally designated by the numeral 40 and a hanger section generally designated by the numeral 42. As best seen in FIG. 2, the body section 40 has a peripheral flange 44 which overlies the flange 24 of the base member 10, and a pedestal portion which is comprised of the peripheral sidewall 46 which extends upwardly and inwardly from the flange 44 and the central wall 48 which defines a multiplicity of upwardly opening recesses 50 therein. As seen in FIGS. 3 and 5, the recesses **50*a*, *b* and *c* extend below the plane of the flanges 24,44 and the central wall 48 thus extends downwardly into the cavity defined within the base member 10**.

The hanger section has two side portions 52 and a bridge portion 54, all of which are of generally inverted U-shaped cross section, an outer flange portion **44*a* extending about the lower outer edge thereof and an inner flange portion 56 extending about the lower inner edge thereof. The top wall 58 is spaced below the plane defined by the adjacent upper edge of the sidewall 46 and of the adjacent end of the central wall 48 so that there is a step between the body and hanger sections 40,42, but extends in essentially the same plane as that portion of the central wall 48 outwardly of the recesses 50 adjacent the opposite or hinge end of the seat member 12. The outer sidewall 46*a* is a continuation of the sidewall 46 of the body section 40, and the outer flange portion 44*a* is a continuation of the flange 44 of the body section 40. The inner sidewall 60 of the bridge and side portions 54,52 blends into the end portion of the sidewall 46 of the body section 40** and is inclined upwardly.

The inner flange portion 56 of the hanger section 42 lies in the same plane as the flange 44 at the end of the body section 40 and blends thereinto.

The closure member 14 has a body section generally designated by the numeral 62 and a hanger section generally designated by the numeral 64. The body section 62 has a central wall 66 which overlies the central wall 48 of the seat member 12 and a sidewall 68 which extends downwardly therefrom along the exterior surface of the sidewall 46 of the seat member 12. At the lower edge of the sidewall 68 is a peripheral flange 70 which extends thereabout and which overlies the flange 44 of the seat member 12. A transverse step in the central wall 44 provides a transverse shoulder 71 which faces the hanger section 64.

The hanger section 64 has a pair of side portions 72 and a bridge portion 74 extending therebetweeen, and it is cooperatively configured with a generally inverted U-shaped cross section and dimensioned to snugly fit over the hanger section 42 of the base member 12. The outer flange portion **70*a* extends about its lower outer edge and an inner flange portion 76 extends about the lower inner edge thereof. As in the case of the seat member hanger section 42, the top wall 78 is spaced below the plane defined by the adjacent upper edge of the sidewall 68 and central wall 66 so that there is a step between the body and hanger sections. The outer sidewall 68*a* is a continuation of the sidewall 68 of the body section 62, and the outer flange portion 70*a* is a continuation of the flange 70 of the body section 62. The inner sidewall 80 of the side and bridge portions 72,74 blends into the end portion of the sidewall 68 of the body section 62, and is inclined upwardly cooperatively with the inner sidewall 60 of the seat member hanger section 42. The inner flange 76 lies in the same plane as the flange 70** at the end of the body section and blends thereinto.

At its end spaced from the hanger section 64, the closure member 16 is hingedly connected to the seat member 14. As seen in FIGS. 2 and 3, the flanges 44 and 70 of the seat and closure members 12,14 are of greater width along this end of the 17 container than along its sides. An inverted U-shaped rib 82 is provided along the flange 70 of the closure member 14 to function as an integral hinge, and the closure member flange 70 is bonded to the seat member flange 44 along the portions thereof outwardly of the rib 82.

A readily releasable frictional lock is provided in the hanger sections 42, 64 of the seat and closure members 12,14, which lock is best seen in FIGS. 1 and 5. The opposed, inner sidewalls 60,80 of the hanger sections 42,64 are provided with cooperatively configured and dimensioned recesses 84,86 intermediate their length and adjacent their flange portions 56,76. When the closure member 14 is pivoted into its closed position, the inner surface of the recesses 86 on the closure member 14 act as bosses which lock into the recesses 86 of the seat member 12.

Figure 6:
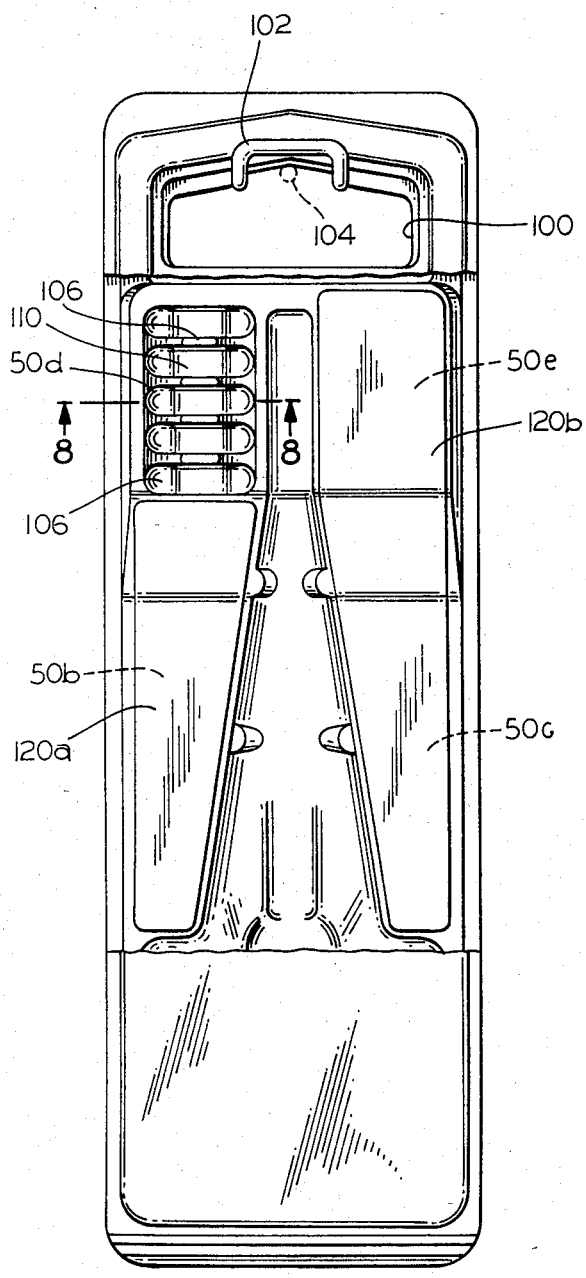
FIG. 6 is a plan view of the container as suspended on a pegboard hook with a loop type hanger shown in full line and a single hanger rod shown in phantom line and with portions of the container broken away to illustrate unused recesses in the seat member with cover members thereover so as to effect masking thereof.

The inner flanges 32, 56 and 76 of the bridge portions of the several hanger sections 18, 42 and 64 have their edges configured to provide a centering action on a pegboard hook or hanger. As best seen in FIG. 2, the edges of the flanges 32, 56 and 76 taper upwardly from the side portions to an apex adjacent the center of the bridge portions 18, 42 and 74. About the center, a cutout or recess 100 is formed in the flanges which is similarly tapered to the apex and is of a width to seat on a loop type pegboard hanger 102 as seen in FIG. 6 in full line. A single element hanger 104 is shown in phantom line as centered at the apex of the cutout 100.

As can be seen, various of the recesses 50 have upstanding ribs 106, 108 which divide the recesses into a multiplicity of compartments 110, 112 to receive multiple items within the general confines of a single recess. These ribs 106, 108 may extend across only a portion of the width of the recess sufficient to effect the partitioning thereof for separating and seating the stored items, as in the instance of the ribs 108. The ribs 106 are of reduced height along their length to facilitate gripping of the items stored therebetween.

In this embodiment, the base member 10 tapers in depth to provide a deeper cavity adjacent its hinge end and thus facilitate the storage of larger articles, or larger portions of non-uniformly dimensioned articles, adjacent that end. Similarly, the pedestal portion of the seat member 12 is higher in elevation from the flange 44 adjacent the hanger end with the the recesses 50 therein being disposed above the plane of its flange 44, and is lower in elevation adjacent the hinge end with the recesses **50*a, b, c* extending to a depth well below the plane of its flange 44. The closure member 14** may vary in elevation along its length more substantially than illustrated; however, a relatively flat face is preferable aesthetically. As a result of the illustrated configuration for the several container members, storage of the tool items of different dimension is readily accommodated within a single container while minimizing the amount of material required and maintaining reasonable strength.

As seen in FIGS. 2 and 6, the container may be sold with some of the recesses **50*d*, 50*e* in the seat member 12 masked by cover members 120 which are adhered to the central wall 48 thereabout. In this manner, the seat member 12 may be molded with a number of recesses to seat various parts, only some of which are included in the package at the time of original sale and other of which may be purchased by the buyer at a later time. Because the appearance of unfilled recesses 50*b, c* and *e* would have an adverse impact upon the customer, masking the unfilled recess 50*b* by the cover member 120*a* and the recesses 50*c* and 50*e* by the longer cover member 120*b* eliminates this impact and improves the appearance of the point of purchase package. Conveniently, these cover members 120** are paper or plastic strips of the same color and texture as the seat member so as to blend therewith.

Moreover, since the hanger sections do not store any items but only serve to suspend and facilitate closure of the container, their height may be reduced substantially to conserve material and to facilitate hanging and carrying.

As assembled for the point of purchase display, an encircling sealing band 15 is provided about the body sections of the container, and it abuts the shoulder 71 of the closure member 14 and frictionally locks on the ribs 27 of the base member 10. Such bands must be broken or removed to gain access, and thus minimize pilferage. The step or shoulder 71 provides a stop for the band or sleeve 15 when it is inserted about the container members, and the band 15 is desirably a heat shrinkable sleeve which will readily shrink tightly onto the other members and frictionally lock on the ribs 27 of the base member which will effect distension thereof from the plane of the adjacent surfaces of the base member 10.

Moreover, insert cards or labels may be inserted into the container, both above and about the stored items to promote the products stored therein or to describe them, and/or to seat them more securely for shipping of the containers.

Figure 8:
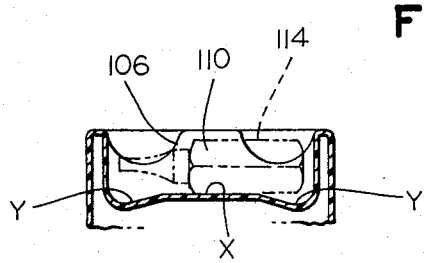
FIG. 8 is a fragmentary sectional view to an enlarged scale through a compartment of one of the recesses and with a tool bit disposed therein to illustrate the rocking action provided by its contour.

To facilitate removal of small articles from the compartments 110, these are preferably configured as seen in FIG. 8. The recesses 50*d* and 50*e* are formed to provide in each of the compartments 110, a central portion X which is elevated relative to the side portions Y which are disposed at the side margins of the recesses 50*d*, and 50*e*. As a result, an elongated tool bit or the like 114 can be pushed down at one end into a lower side portion Y causing its other end to pivot upwardly for convenient gripping.

The sidewalls of the seat and closure members are cooperatively inclined and configured so that the closure member sidewall closely overlies the seat member sidewall to provide some measure of frictional engagement therewith to augment the frictional engagement of the locks in the hanger sections. This frictional engagement is enhanced by use of slightly different angles for the sidewalls so that the closure member has an interference fit over the base member.

It will be appreciated that the closure and base members may be utilized with a variety of seat members which are configured to provide recesses for different sets of stored articles. Thus, only one set of variable molds is necessary and the cost of thermoforming molds and inventory of parts can be minimized.

The base, seat and closure members are readily and economically formed from synthetic resin sheet material by thermoforming techniques. The resins used for the sheet material include polyvinyl chloride, vinyl chloride interpolymers, polyolefins such as polyethylene and polypropylene, and polystyrene and high impact polystyrene. Generally, the sheeting before thermoforming will have a thickness of about 10–35 mils depending upon the depth of draw to be effected, the weight and size of the articles to be stored therein, and the particular resin employed. Different resin sheeting may be used for the several members if so desired.

Following thermoforming, the seat member and base member are assembled and are bonded together along their flanges by sonic or heat sealing, or by an interposed adhesive. The closure member may have its integral hinge formed in a separate step and, when assembled to the base member, is bonded thereto outwardly of the hinge.

The cover members for the unused recesses are conveniently paper or plastic strips provided with an adhesive coating to effect bonding to the seat member. Most easily, precoated strips are utilized with the adhesive covered by release paper. The cover members may be imprinted if so desired but preferably have a color and texture conforming to that of the wall upon which secured. The adhesive bond should be such that the cover member may be pulled off by the purchaser when he acquires items to be stored in the compartments thereunder.

From cost and assembly standpoints, the hinge is desirably an integral part of the closure member. However, a separate hinge element may be provided to hinge the closure to the seat member.

After insertion of the products into the container recesses, the sleeve is secured thereabout. The sealing band or sleeve is desirably an oriented polyvinyl chloride shrink film of tubular character and about 3–10 mils in thickness. Accordingly, a stream of hot air will effect its shrinkage. The sleeve may be imprinted if so desired for merchandising purposes but should not excessively mask the items stored therein.

Thus, it can be seen that the display and storage containers of the present invention are relatively economical to fabricate and assemble from synthetic plastic sheet material to store a variety of tool and like items. The containers provide an attractive point of purchase display unit which may be hung on pegboard hooks, and one of the components may be readily varied to accommodate different tools sets to be displayed and stored therein, and unused compartments may be readily masked until the customer desires to store separately purchased items therein.

Having thus described the invention, I claim:

1. A unitized display and storage container for multiple items including:

A. a base member of synthetic resin having a body section of generally U-shaped cross section defined by a bottom wall and sidewall providing an upwardly opening cavity therebetween, and a peripheral flange extending outwardly from the upper edge of said sidewall and about at least the major portion of the periphery thereof;

B. a seat member of synthetic resin material having a body section with a peripheral flange extending outwardly and about at least the major portion of the periphery thereof and overlying said flange of said base member, said seat member also having an upstanding pedestal portion within said peripheral flange and comprising a peripheral sidewall extending upwardly from said peripheral flange and a central wall portion inwardly of said sidewall defining a multiplicity of upwardly opening recesses, the central wall portion at the bottom of at least one recess extending below the plane of the peripheral flanges of said seat and base members and into the cavity defined by said base member, another of said recesses being divided by ribs spaced along it length into a multiplicity of upwardly opening elongated compartments extending between its sides, the central wall defining the base of said compartments being lower adjacent said sides than in the center thereof, whereby elongated elements stored therein may be readily gripped by pressing one end of the associated element downwardly to pivot the other end upwardly;

C. a cover sheet overlying another one of said recesses of said seat member and adhered to said central wall portion thereabout to mask the recess thereunder;

D. a closure member having a body section with a central wall portion overlying said central wall portion of said seat member, a sidewall portion extending downwardly therefrom along the exterior surface of said peripheral sidewall of said seat member, and a peripheral flange portion extending outwardly about at least the major portion of the periphery of said sidewall and overlying said flange of said seat member, said sidewall of said closure member frictionally engaging said sidewall of said seat member in the closed position thereof; and E. a band of transparent synthetic resin material tightly encircling said base member and closure member.

2. The container of claim 1 wherein said central wall portion of said closure member has a transverse shoulder along the length thereof and wherein one edge of said band abuts and extends along said shoulder.

3. The container of claim 1 wherein there is included means hingedly engaging said closure member to said seat member along a portion of their periphery whereby the closure member may be pivoted upwardly into a position permitting access to items stored in said seat member.

4. The container of claim 1 wherein said base and seat members have a body section as defined therein and including cooperatively configured and dimensioned hanger extensions at one end of said body section of said base and seat members, said hanger extensions having abutting flanges and encompassing an aperture extending therethrough to provide a means for hanging said container on an associated support member and wherein said closure member has a body section as defined therein and including a cooperatively dimensioned and configured hanger extension at one end of said body section of said closure member, said hanger extension having a flange abutting that of said seat member and encompassing an aperture therethrough aligned with the apertures in said base and seat members.

5. The container of claim 1 wherein said base, seat and closure members have a body section as defined therein and including cooperatively configured and dimensioned hanger extensions at one end of said body section of said base, seat and closure members, said hanger extensions having abutting flanges and encompassing an aperture extending therethrough to provide a means for hanging said container on an associated support member, said hanger extensions being comprised of side portions extending from the sides of said body sections thereof and a bridge portion extending between said side portions at a point spaced from the body section thereof to define said apertures therebetween, said side and bridge portions of said base member being of a cross section defined by a generally U-shaped central segment and outwardly extending flanges at the upper ends thereof, said side and bridge portions of said seat and closure members being of a cross section defined by a generally inverted U-shaped central segment and outwardly extending flanges at the lower ends thereof.

6. The container of claim 5 wherein said central segments are each defined by a pair of generally vertically extending legs and a web extending therebetween, at least one leg of each of said closure and seat members having cooperatively dimensioned and configured recesses formed therein, the inside surface of the recess in the leg of said closure member functioning as a boss frictionally seated in the recess in the leg of the seat member to provide a frictional interlock therebetween.

7. The container of claim 6 wherein said recesses are provided on the opposed legs of the segments along each of the side portions of said hanger extensions.

8. The container of claim 5 wherein the outer edges of the inwardly disposed flanges of said bridge portions of said several hanger sections have portions which are inclined from the side portions of the hanger sections to an apex centrally of the bridge portion to facilitate centering of the container on a single hanger element.

9. The container of claim 8 wherein said outer edges have a recessed portion about said apex dimensioned to seat a hanger of the type having a pair of spaced hanger elements.

10. The container of claim 1 wherein said base member has ribs spaced along its length underlying said band and said band is distended by said ribs to form an interlock therewith.

11. A unitized display and storage container for multiple items including:

A. a base member of synthetic resin having a body section of generally U-shaped cross section defined by a bottom wall and sidewall providing an upwardly opening cavity therebetween, and a peripheral flange extending outwardly from the upper edge of said sidewall and about at least the major portion of the periphery thereof;

B. a seat member of synthetic resin material having a body section with a peripheral flange extending outwardly and about at least the major portion of the periphery thereof and overlying said flange of said base member, said seat member also having an upstanding pedestal portion within said peripheral flange and comprising a peripheral sidewall extending upwardly from said peripheral flange and a central wall portion inwardly of said sidewall defining a multiplicity of upwardly opening recesses, said central wall portion having a multiplicity of upstanding ribs along one of said recesses to define a multiplicity of elongated, upwardly opening tool receiving compartments extending between its sides, the central wall defining the base of said compartments being lower adjacent said sides than in the center thereof, whereby associated elongated elements stored therein may be readily gripped by pressing one end of the element downwardly to pivot the other end upwardly;

C. a cover sheet overlying one of said recesses of said seat member and adhered to said central wall thereabout to mask the recess thereunder; and D. a closure member having a body section with a central wall portion overlying said central wall portion of said seat member, a sidewall portion extending downwardly therefrom along the exterior surface of said peripheral sidewall of said seat member, and a peripheral flange portion extending outwardly about at least the major portion of the periphery of said sidewall and overlying said flange of said seat member, said sidewall of said closure member frictionally engaging said sidewall of said seat member in the closed position thereof, said closure member including means hingedly engaging said closure member to said seat member along a portion of their periphery, whereby the closure member may be pivoted upwardly into a position permitting access to items stored in said seat member.

12. The container of claim 11 wherein said base, seat and closure members have a body section as defined therein and include cooperatively configured and dimensioned hanger extensions at one end of said body sections of said base, seat and closure members, said hanger extensions having abutting flanges and encompassing an aperture extending therethrough to provide a means for hanging said container on an associated support member, said hanger extensions being comprised of side portions extending from the sides of said body sections thereof and a bridge portion extending between said side portions at a point spaced from the body section thereof to define said apertures therebetween, said side and bridge portions of said base member being of a cross section defined by a generally U-shaped central segment and outwardly extending flanges at the upper ends thereof, said side and bridge portions of said seat and closure members being of a cross section defined by a generally inverted U-shaped central segment and outwardly extending flanges at the lower ends thereof, and wherein the outer edges of the inwardly disposed flanges of said bridge portions of said several hanger sections have portions which are inclined from the side portions of the hanger section to an apex centrally of the bridge portion to facilitate centering of the container on a single hanger element.

13. The container of claim 12 wherein said outer edges have a recessed portion about said apex dimensioned to seat a hanger of the type having a pair of spaced hanger elements.

14. A unitized display and storage container for multiple items including:

A. a base member of synthetic resin having a body section of generally U-shaped cross section defined by a bottom wall and sidewall providing an upwardly opening cavity therebetween, and a peripheral flange extending outwardly from the upper edge of said sidewall and about at least the major portion of the periphery thereof, said base member also having a hanger extension at one end of said body section;

B. a seat member of synthetic resin material having a body section with a peripheral flange extending outwardly and about at least the major portion of the periphery thereof and overlying said flange of said base member, said seat member also having an upstanding pedestal portion within said peripheral flange comprising a peripheral sidewall extending upwardly from said peripheral flange and a central wall portion inwardly of said sidewall defining a multiplicity of upwardly opening recesses, said seat member also having a hanger extension at one end of said body section, said central wall portion having a multiplicity of upstanding ribs in at least one of said recesses defining a multiplicity of upwardly opening tool receiving compartments, said flanges of said base and seat members extending about substantially the entire periphery thereof and being bonded to seal the cavity defined within said base member;

C. a closure member having a body section with a central wall portion overlying said central wall portion of said seat member, a sidewall portion extending downwardly therefrom along the exterior surface of said peripheral sidewall of said seat member, and a peripheral flange portion extending outwardly about at least the major portion of the periphery of said sidewall and overlying said flange of said seat member, said sidewall of said closure member frictionally engaging said sidewall of said seat member in the closed position thereof, said closure member also having a hanger extension at one end of said body section, said hanger extension having a flange abutting that of said seat member and encompassing an aperture therethrough aligned with the apertures in said base and seat members, said closure member including means hingedly engaging said closure member to said seat member along a portion of their periphery at the end opposite said hanger extensions thereof, whereby the closure member may be pivoted upwardly into a position permitting access to items stored in said seat member, said hanger extensions having abutting flanges and encompassing an aperture extending therethrough to provide a means for hanging said container on an associated support member, said hanger extensions being comprised of side portions extending from the sides of said body sections thereof and a bridge portion extending between said side portions at a point spaced from the body section thereof to define said apertures therebetween, said side and bridge portions of said base member being of a cross section defined by a generally U-shaped central segment and outwardly extending flanges at the upper ends thereof, said side and bridge portions of said seat and closure members being of a cross section defined by a generally inverted U-shaped central segment and outwardly extending flanges at the lower ends thereof, the outer edges of the inwardly disposed flanges of said bridge portions of said several hanger section having portions which are inclined from the side portions of the hanger sections to an apex centrally of the bridge portions to facilitate centering of the container on a single hanger element.

15. The container of claim 14 wherein said outer edges have a recessed portion about said apex dimensioned to seat a hanger of the type having a pair of spaced hanger elements.

16. A unitized display and storage container for multiple items including:

A. a base member of synthetic resin having a body section of generally U-shaped cross section defined by a bottom wall and sidewall providing an upwardly opening cavity therebetween, and a peripheral flange extending outwardly from the upper edge of said sidewall and about at least the major portion of the periphery thereof;

B. a seat member of synthetic resin material having a body section with a peripheral flange extending outwardly and about at least the major portion of the periphery thereof and overlying said flange of said base member, said seat member also having an upstanding pedestal portion within said peripheral flange comprising a peripheral sidewall extending upwardly from said peripheral flange and a central wall portion inwardly of said sidewall defining a multiplicity of upwardly opening recesses, said central wall portion having a multiplicity of upstanding ribs in at least one of said recesses defining a multiplicity of upwardly opening tool receiving compartments therebetween, said flanges of said base and seat members extending about substantially the entire periphery thereof and being bonded to seal the cavity defined within said base member;

C. a closure member having a body section with a central wall portion overlying said central wall portion of said seat member, a sidewall portion extending downwardly therefrom along the exterior surface of said peripheral sidewall of said seat member, and a peripheral flange portion extending outwardly about at least the major portion of the periphery of said sidewall and overlying said flange of said seat member, said sidewall of said closure member frictionally engaging said sidewall of said seat member in the closed position thereof, said closure member including means hingedly engaging said closure member to said seat member along a portion of their periphery, whereby the closure member may be pivoted upwardly into a position permitting access to items stored in said seat member; and D. a band of transparent synthetic material tightly encircling said base member and closure member, at least one of said closure and base members having means thereon to lock the bank thereon.

17. The container of claim 16 wherein said locking means is provided by a plurality of ribs spaced along the length of said base member underlying said band and distending said band to form an interlock therewith.

18. The container of claim 16 wherein said central wall of said closure member has a transverse shoulder along the length thereof and wherein one edge of said band abuts and extends along said shoulder.

* * * * *